United States Patent [19]

Gardiner et al.

[11] 4,191,088

[45] Mar. 4, 1980

[54] AMMUNITION FEEDER HAVING TWO FEED PAWLS

[75] Inventors: Arthur L. Gardiner, Tustin; Tomas R. Castillo, Fountain Valley, both of Calif.

[73] Assignee: The United States of America as represented by the Secretary of the Army, Washington, D.C.

[21] Appl. No.: 894,663

[22] Filed: Apr. 10, 1978

[51] Int. Cl.[2] ..... F41D 9/02

[52] U.S. Cl. ..... 89/33 C

[58] Field of Search ..... 89/33 BB, 33 C

[56] References Cited

FOREIGN PATENT DOCUMENTS 1231602 9/1960 France ..... 89/33 C 6949 of 1907 United Kingdom ..... 89/34

*Primary Examiner*—Stephen C. Bentley

*Attorney, Agent, or Firm*—Nathan Edelberg; Robert P. Gibson; Peter A. Taucher

[57] ABSTRACT

An ammunition feeder for delivering rounds of ammunition from a belt into the barrel of a gun, comprising a reciprocatory carrier having two separate pawls thereon. One the pawls acts as a main feeder for successively advancing individual rounds of ammunition from an entry station to an intermediate station during each upstroke of the carrier; the other pawl acts as a restraining device to prevent excessive upward movement of the ammunition belt during periods of high carrier acceleration. The second pawl also acts as a feed pawl for the last round of ammunition on the belt (when the main feed pawl then sees a vacant station).

1 Claim, 3 Drawing Figures

Fig-1
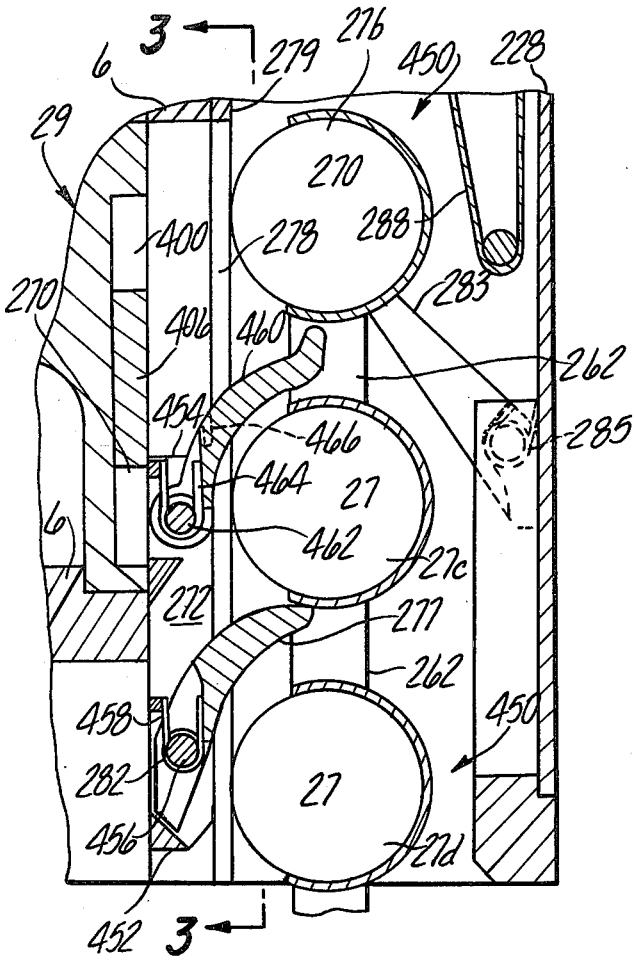
Fig-2
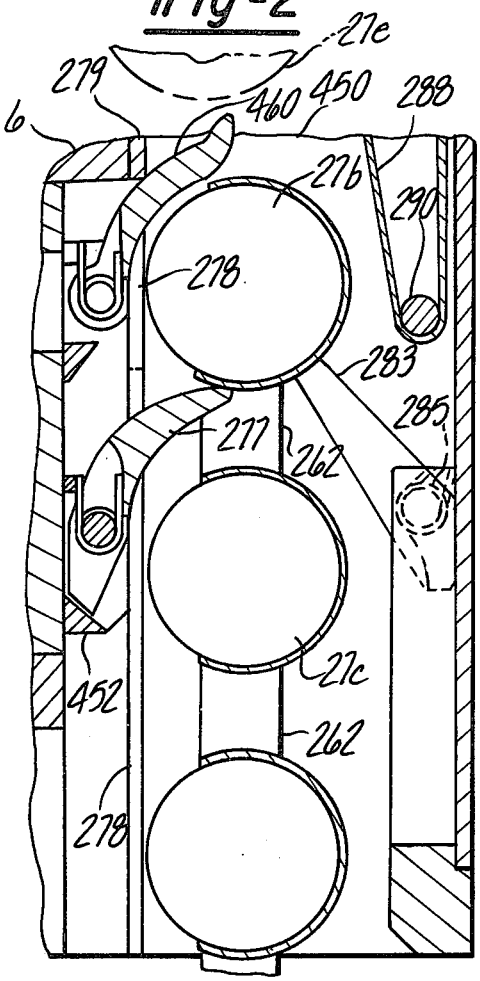
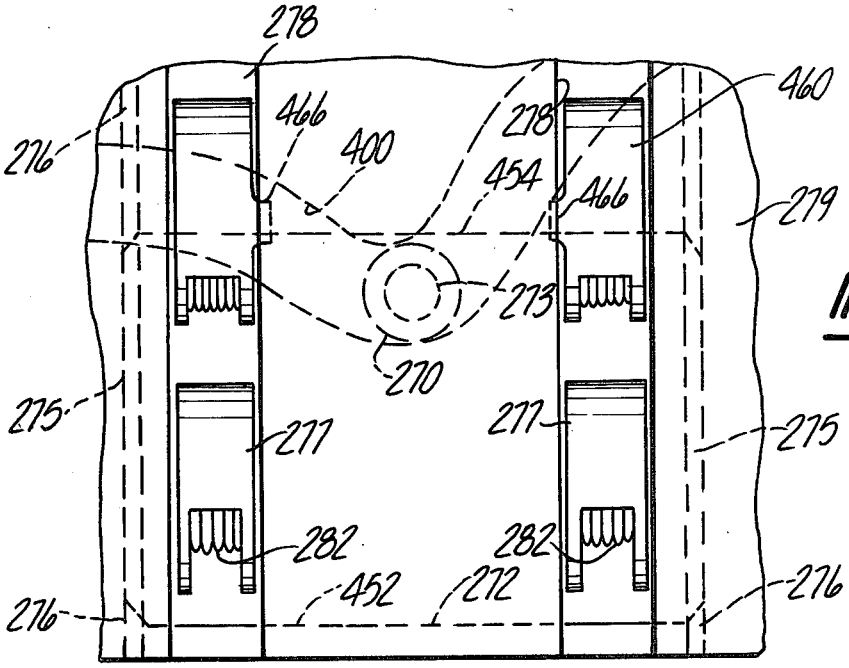
Fig-3

AMMUNITION FEEDER HAVING TWO FEED PAWLS

BACKGROUND AND SUMMARY OF THE INVENTION

U.S. Pat. No. 3,630,118 issued to Eugene Stoner on Dec. 28, 1971 shows an ammunition feeder mechanism for delivering individual rounds of ammunition from a belt into a barrel of a gun. The feeder comprises a vertically movable carrier having a feed pawl swingably mounted thereon for advancing the ammunition belt upwardly through an ammunition tray positioned alongside the barrel of the gun. The carrier in the feeder is operatively connected with the bolt carrier in the gun so that reciprocation of the bolt carrier along the gun barrel axis (assumed to be horizontal) causes the feed carrier to reciprocate vertically, thereby advancing the belt of ammunition upwardly to a position alongside the barrel of the gun. Injector mechanism within the feeder forces the uppermost round of ammunition into the path of the bolt carrier, which then propels the ammunition round into the barrel of the gun.

The feeder mechanism in U.S. Pat. No. 3,630,118 has no provision for moving the last round of ammunition on the belt into the injection station at the level of the gun barrel; the number of stations in the feeder are such that after the feed pawl has advanced the last round of ammunition from the entry station to an intermediate station there is no feeder mechanism for further moving the last round to the uppermost gun injection station. The present invention involves a modification of the patented system to incorporate a second pawl for giving the feeder a last round feed capability. The mechanism is designed so that this second pawl also limits the speed or position of the ammunition belt at the end of each feed stroke, thereby minimizing any tendency for the mechanism to jam due to excessive acceleration of the belt due to rapid upstroke of the main feed pawl.

The invention described herein may be manufactured, used, and licensed by or for the Government for governmental purposes without payment to us of any royalty thereon.

THE DRAWINGS

FIG. 1 is a sectional view through a feeder mechanism embodying this invention.

FIG. 2 is a view similar to FIG. 1 but showing the mechanism at the end of the feeder stroke.

FIG. 3 is a fragmentary view taken on line 3—3 in FIG. 1.

As noted previously, the present invention involves a modification of the ammunition feeder disclosed in U.S. Pat. No. 3,630,118. The instant drawings are directed particularly to the feeder modifications; these drawings do not show the entire feeder system. Reference to U.S. Pat. No. 3,630,118 is necessary for an understanding of the entire feeder. To facilitate such an understanding the present drawings utilize similar reference numerals for corresponding parts in the patented feeder and in the present (modified) feeder.

Attached FIG. 1 fragmentarily shows a gun having a receiver 6 slidably accommodating a bolt carrier 29 for horizontal reciprocatory motion into and out of the plane of the paper, i.e. along the gun barrel axis. Positioned alongside the gun mechanism is an ammunition tray 288 that defines a vertical chute 450 for receiving a belt 262 containing individual rounds of ammunition 27.

Feeder mechanism associated with the tray causes the belt of ammunition to be advanced upwardly through chute 450 to a position alongside the barrel of the gun (not shown). A guide spring 288 near the upper end of chute 450 displaces the uppermost round of ammunition leftwardly into the path of the bolt carrier, which then propels the round into the barrel of the gun, as more particularly described in U.S. Pat. No. 3,630,118.

Feeder mechanism for advancing the belt of ammunition upwardly through chute 450 comprises a plate-like carrier 272 having a lower edge 452 and an upper edge 454. The carrier is guided for vertical motion by means of tongues 275 projecting laterally from the side edges of the carrier into grooves 276 formed in the aforementioned receiver 6. The shifter mechanism for reciprocating carrier 272 between its FIG. 1 and FIG. 2 positions is the same as that shown in U.S. Pat. No. 3,630,118. As shown in present FIGS. 1 and 2, the shifter mechanism comprises a cam follower roller 270 mounted on carrier 272 for tracking movement in a cam slot 400 formed in the side surface of bolt carier 29. A tiltable ramp element 406 is mounted on the bolt carrier to subdivide slot 400 into a loop-like track structure. Horizontal reciprocation of the bolt carrier causes cam follower 270 to oscillate vertically; the tongue-groove structures 275–276 guide carrier 272 for vertical movement.

FIG. 1 illustrates carrier 272 in its starting (lowered) position preparatory to the next feed stroke. FIG. 2 illustrates the carrier after completion of the feed stroke. The stroke distance corresponds to the centerline spacing of the individual rounds of ammunition 27, so that each upstroke of the carrier advances a given round of ammunition to the position previously occupied by the next higher round. For example, one upstroke of carrier 272 advances a gun round from position **27*c* (FIG. 1) to position 27*b* (FIG. 2). Thereafter, the carrier 272 retracts downwardly to the FIG. 1 position for the next feed upstroke. Position 27*c* may be considered as a lower ammunition belt entry station, whereas position 27*b* may be considered an intermediate station; the ammunition round is injected into the gun from an upper injection station designated generally by reference numeral 27*e* (FIG. 2). The impetus for propelling the round laterally toward the gun barrel is provided by a guide spring 288**.

The mechanism for applying upward force to the ammunition belt in chute 450 comprises two feed pawls 277, each pivotally connected to the carrier 272 by means of a pivot pin 456; each pivot pin is encircled by a torsion hairpin spring 458, said spring applying a resilient clockwise biasing force on the associated feed pawl 277. During each upstroke of carrier 272 the feed pawls 277 apply a lifting force to the superjacent ammunition round; during the ensuing downstroke of the carrier 272 the feed pawls cam downwardly on the surface of the round. The ammunition belt system is retained against downward displacement by means of retaining pawls 283 individually biased in counterclockwise directions by torsion springs 285.

The mechanism thus far described is the same as that shown in U.S. Pat. No. 3,630,118. The new structure contributed by the present invention comprises two additional pawls 460 individually mounted for swinging motion on the carrier 272 by means of pivot pins 462; torsion springs 464 encircle the respective pivot pins to bias the pawls 460 in clockwise directions. Such pawl movement is limited by tabs 466 that project laterally from the individual pawls beyond the edges of the slots 278 in stationary walls 279. The primary function of each pawl 460 is to act as a feed device for the last round of ammunition on the belt. A second function of each pawl 460 is to limit excessive upward acceleration of the belt system during normal feed operations by pawls 277.

With respect to the last-round feed capability of pawls 460, it will be appreciated that when the last round on the belt arrives at station 27*c* the next upstroke of the carrier will cause pawl 277 to deliver the last round to station 27*b*. However there is then no feeder device for delivering that round to station 27*e* (in the absence of pawls 460). When pawls 460 are incorporated in the system they act as feed pawls for delivering the last round of ammunition from station 27*b* to station 27*e*.

With respect to the acceleration-limiting function of pawls 460, it will be seen that when pawls 460 are elevated to the FIG. 2 position they substantially engage the upper end edges of stationary slots 278, so that pawls 460 cannot then swing in counterclockwise directions. Each end edge of a slot 278 constitutes a stationary abutment for limiting movement of the associated pawl 460. The undersurfaces of pawls 460 overlie the upper surfaces of the ammunition round in station 27*b*. Therefore, even though the feed pawls 277 may impart high acceleration forces to the ammunition belt, the pawls 460 will prevent the belt system from moving more than the desired stroke distance during each upward indexing of carrier 272. Pawls 460 act as round control pawls to prevent possible jamming of the belt system.

Each pawl 460 is configured slightly differently than the companion pawl 277, thus, each pawl 460 includes a relatively thin intermediate arcuate wall section conforming to the contour of the subjacent ammunition round so that the undersurface of the pawl is relatively close to the upper surface of the subjacent round; the aim is to enable the pawl to better perform its round acceleration-limiting function. The free end of each pawl 460 is upturned to at least approximately engage the undersurface of the next higher round, the aim being to enable the pawl to accomplish a full upstroke when it becomes necessary to feed the last round from station 27*b* to station 27*e*. The thickness and specific shape of each pawl 460 should be selected so that during each downstroke of the carrier 272 the pawls 460 will cam smoothly on the surface of the ammunition round in station 27b without jamming or wedging in the clearance spaces at the upper edges of slots 278.

We wish it to be understood that we do not desire to be limited to the exact details of construction shown and described for obvious modifications will occur to a person skilled in the art.

We claim:

1. In a feeder for delivering ammunition rounds from a belt into the barrel of a gun, said feeder comprising a lower ammunition belt entry station (27*c*) below the level of the gun barrel, an upper ammunition round injection station (27*e*) at the level of the gun barrel, and an intermediate station (27*b*) equidistant from the upper and lower stations; a pawl carrier (272) mounted for vertical reciprocatory motion through a stroke distance corresponding to the station spacing; and a feed pawl (277) located on the carrier to advance individual rounds of ammunition from the entry station to the intermediate station during each upstroke of the carrier:

the improvement comprising a second pawl (460) swingably mounted on the carrier directly above the feed pawl, whereby said second pawl feeds the last round of ammunition from the intermediate station to the injection station; a stationary abutment in line with the second pawl to limit upward movement of said second pawl and thereby prevent excessive upward movement of the ammunition belt at conclusion of each carrier upstroke; spring means (464) biasing the second pawl toward a position underlying a round of ammunition on the belt, and means (466) limiting movement of the second pawl by the spring means; said second pawl including a relatively thin arcuate wall having an undersurface conforming to the contour of the ammunition round therebelow, and an upturned tip extending from the arcuate wall to engage the undersurface of the next higher round; the arcuate contour of the second pawl being predetermined so that during each downstroke of the carrier the second pawl slides through the clearance space between the stationary abutment and the round of ammunition in the intermediate station.

* * * * *